United States Patent [19]

Kuo

[11] Patent Number: 4,630,322

[45] Date of Patent: Dec. 23, 1986

[54] SPRAYING-ANGLE SELECTOR FOR A TOILET HAVING ADJUSTABLE WATER-SPRAY NOZZLES

[76] Inventor: Dai-Ming Kuo, P.O. Box 10160, Taipei, Taiwan

[21] Appl. No.: 849,255

[22] Filed: Apr. 7, 1986

Related U.S. Application Data

[63] Continuation-in-part of Ser. No. 779,833, Sep. 25, 1985.

[51] Int. Cl.[4] ..... A47K 3/20

[52] U.S. Cl. ..... 4/420.4

[58] Field of Search ..... 4/420.1–420.5, 4/443–448

[56] References Cited

U.S. PATENT DOCUMENTS 2,058,003 10/1936 Davies ..... 4/420.1 X
2,104,271 1/1938 Parisini ..... 4/448
3,015,826 1/1962 Aranas ..... 4/420.4
3,916,453 11/1975 Dominguez-Armada ..... 4/445
3,947,899 4/1976 Robinson et al. ..... 4/420.2 X
4,551,867 11/1985 Gurevich et al. ..... 4/420.5 X

*Primary Examiner*—Charles E. Phillips

[57] ABSTRACT

A spraying-angle selector includes a rotating knob movably mounted in an upper plate, a stepwise driving element driven by the rotating knob, a driving bellows fixed under the driving element and inserted with a restoring spring inside the bellows, and a bottom plate combined with the upper plate to be fixed on a toilet seat, whereby upon the rotation of the knob, the driving element will be descended to compress the driving bellows to squeeze the internal air into a follower bellows secured with a nozzle, adapted for washing the human anus or genitals portion, so as to bias the nozzle to selectively obtain an optimum water-spray angle for the specific user.

1 Claim, 5 Drawing Figures

SPRAYING-ANGLE SELECTOR FOR A TOILET HAVING ADJUSTABLE WATER-SPRAY NOZZLES

BACKGROUND OF THE INVENTION

This application is a continuation-in-part of original application of Ser. No. 779,833 filed on Sept. 25, 1985 by the same applicant. The original application discloses a toilet having a spraying-angle adjuster 5 which includes a follower bellows 51 having a collar 54 for fixing either a rear-side nozzle 3 adapted for spraying human anus or a front-side nozzle 4 adapted for spraying human genitals within the collar 54, an air tube 52 fluidically connected with the bellows 51 and secured to a toilet seat A riding on bowl B by a bracket 55, and a hollow ball 53 fluidically connected with the tube 52, whereby upon the depression of the ball 53, the bellows 51 will be expanded to move either nozzle 3 or 4 about either flexible portion 32 or 42 of water conduit 31 or 41 to optionally adjust the water-spraying angle of each nozzle for thoroughly cleaning human anus or genitals portion.

However, if the user wants to fix the water-spraying angle to be a specific value, he or she must always grasp the hollow ball 53 to thereby be easily tired or bored. If the ball 53 is uncarefully released, the spraying angle will be suddenly changed. In order to obtain the desired optimum spraying angle for the user of different age, style or sex, the user may waste much time, after trial and error, for adjusting his or her desired angle.

The present inventor has found the inconvenient defect of original application and invented the present spraying-angle selector for a toilet.

SUMMARY OF THE INVENTION

The object of the present invention is to provide a spraying-angle selector to substitute the hollow ball 53 of the original application, in which the selector includes a rotating knob movably mounted in an upper plate, a stepwise driving element driven by the knob, a driving bellows fixed under the driving element and inserted with a restoring spring within the driving bellows, and a bottom plate fixing the lower portion of the driving bellows and combined with the upper plate by several connecting rods, whereby upon the rotation of the knob, the driving bellows will be compressed to squeeze the fluid in the driving bellows to expand the follower bellows secured with either nozzle 3 or 4 to bias either nozzle for spraying water in a selected spraying angle.

DETAILED DESCRIPTION

Figure 1:
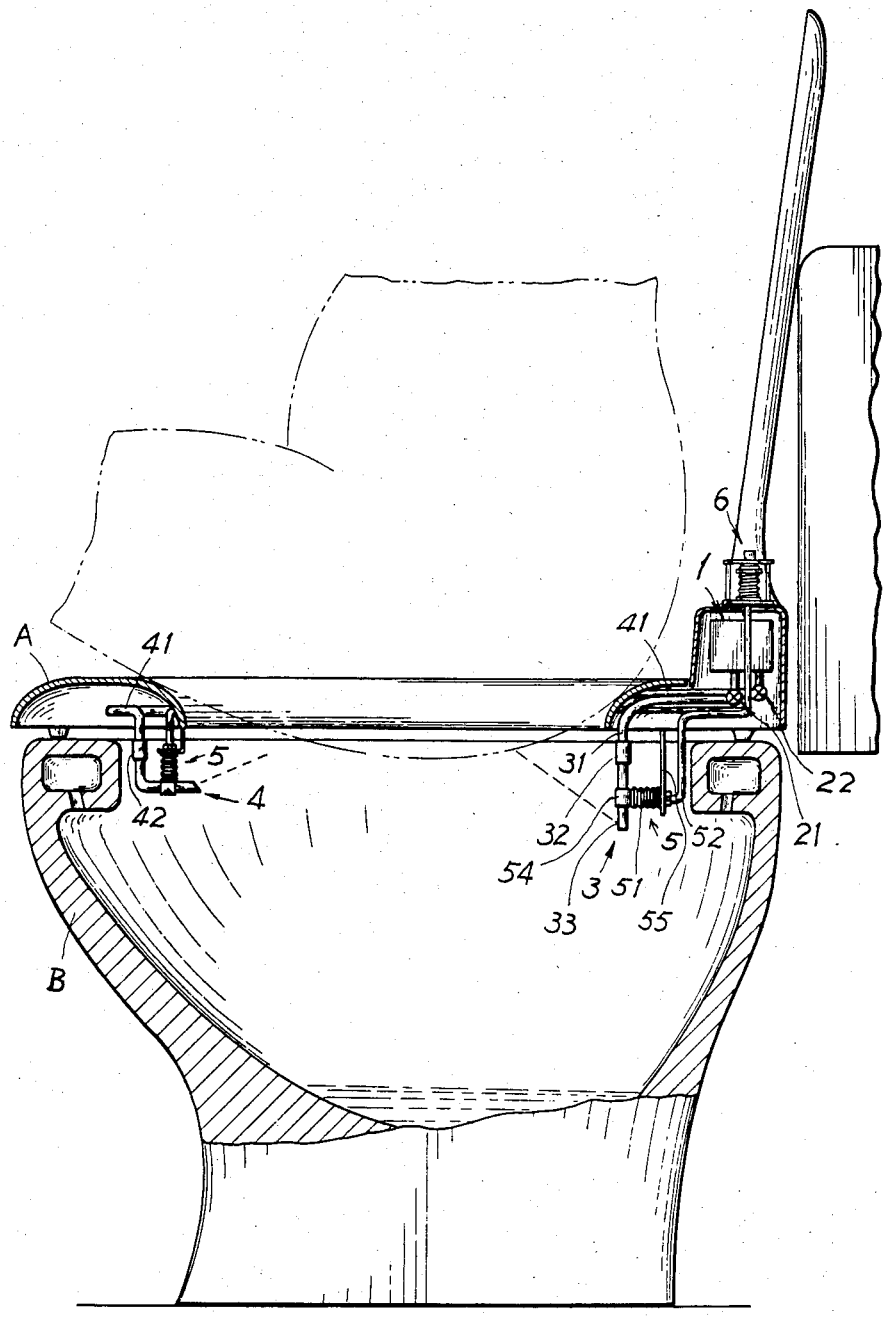
FIG. 1 is an illustration showing the application of the present invention.
Figure 2:
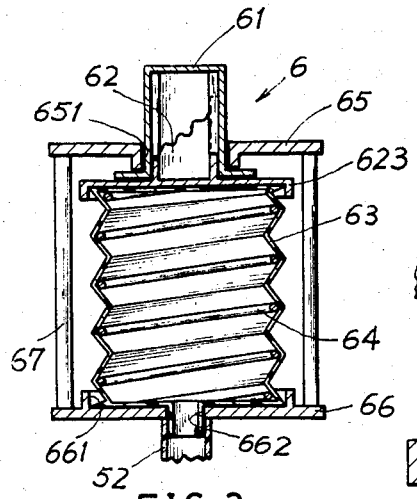
FIG. 2 is a sectional drawing of the present invention.
Figure 3:
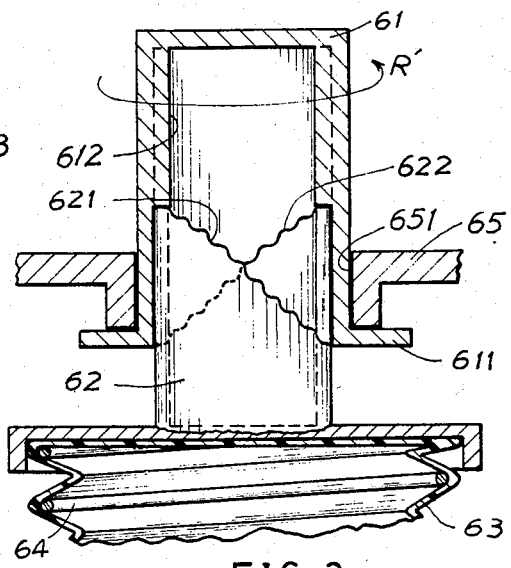
FIG. 3 shows the operation of the knob and the driving element in accordance with the present invention.

As shown in the figures, the present invention comprises: a rotating knob 61, a stepwise driving element 62, a driving bellows 63, a restoring spring 64, an upper plate 65, a bottom plate 66 and several connecting rods 67.

The rotating knob 61 is a hollow cylinder with enclosed top cover and movably mounted in a central hole 651 of the upper plate 65. The knob 61 includes a bottom flange 611, two longitudinal keys 612 symmetrically formed inside the cylindrical wall of the knob and each key having a lower tapered end (not shown), and an indicating mark 613 formed on the top surface of the knob to operatively point the arabic numerals 1–9 of the scale 652 printed on the plate 65 so as to indicate the selected specific angle of water spray. For example, numeral "1" means a lower (minimum) degrees and "9" means a higher (maximum) degrees.

The stepwise driving element 62 is formed as a cylinder movably jacketed within the knob 61 and formed with a set of rightward-inclined teeth 621 and a set of leftward-inclined teeth 622, respectively formed on two helical slope-surfaces which are equally divided along the perimeter of the cylinder of the driving element 62. A disk portion 623 is formed on the bottom portion of the element 62 to fix the upper end of the driving bellows 63. Either set of teeth 621 or 622 is operatively engaged with the lower tapered end of each longitudinal key 612.

The driving bellows 63 is inserted with a restoring spring 64 inside the bellows 63 and the lower end of the bellows 63 is fixed into a socket 661 of the bottom plate 66 which is installed on the toilet seat or a frame near the toilet and is combined with the upper plate 65 by several connecting rods 67 linked between the two plates 65, 66. A bottom hole 662 is formed on the plate 66 to fluidically connect the tube 52 directing the fluid in the driving bellows 63 towards the follower bellows 51 of the spraying-angle adjuster 5.

Figure 4:
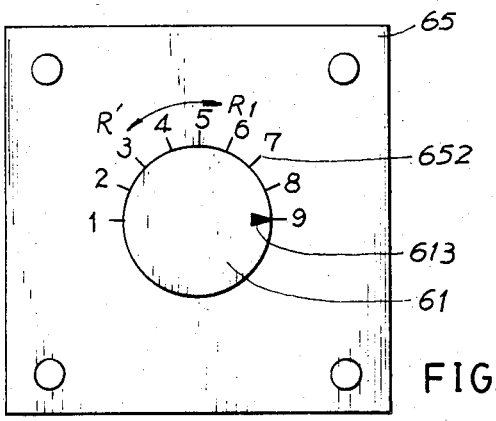
FIG. 4 is a top-view of the knob and the upper plate of the present invention.
Figure 5:
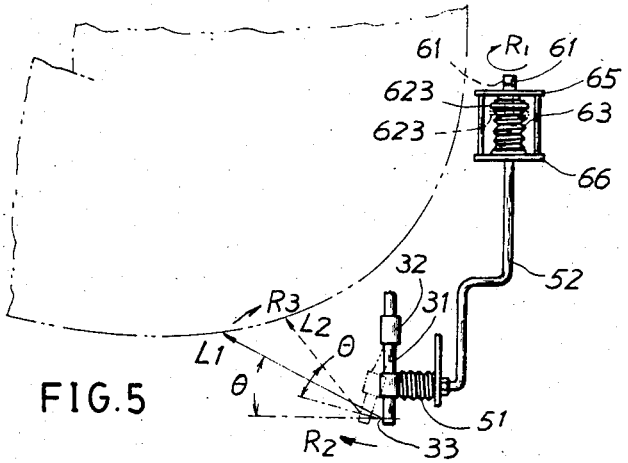
FIG. 5 is an illustration showing the adjustment of spraying angle of the present invention.

When using the present invention, the nozzle 3 having a fixed spraying angle $\theta$ with water-spray direction L1 as shown in full line of FIG. 5 can be biased for changing its spraying direction when rotating the knob clockwise (direction R1) from original numeral "1" towards numeral "2", for instance, the longitudinal keys 612 will rotationally drive the two set teeth 621, 622 to descend the driving element 62 to press the driving bellows 63 so as to compress the internal fluid to expand the lower follower bellows 51 to bias the nozzle 33 in a direction R2 and to vary the spray direction clockwise (R3) from L1 to L2 as shown in dotted line of FIG. 5. By stepwise rotating the knob 61 in a direction R1 as shown in FIG. 4 until reaching the uttermost numeral "9", the highest water-spraying angle of either nozzle 3 or 4 can be obtained. If rotating the knob 61 counterclockwise (R'), the restoring spring 64 within the bellows 64 will recover the element 62, knob 61 to retract either nozzle 3, 4 to its original position having lower spraying angle.

Accordingly, this invention can be applied to rotate the knob 61 to selectively obtain a desired optimum spraying angle which is suitable for the user having his or her specific preferable spraying angle, which once being set by the user as indicated by one of the arabic numerals 1–9 shown on the upper plate 65, he or she will quickly and conveniently get the preferable angle in user, without wasting time to find out the angle through trial-and-errors as usual way as taught by the inventor's original application.

I claim:

1. A spraying-angle selector for a toilet having adjustable water-spray nozzles comprising: a rotating knob having a hollow cylindrical interior wall and being movably mounted in an upper plate, said interior wall formed with two longitudinal keys, each having a lower tapered end, said keys being symmetrically formed on said wall of the knob, said upper plate having an indicating mark formed on the top surface thereof; a stepwise driving element formed as a cylinder and movably jacketed within said cylindrical interior and formed with a set of rightward-inclined teeth and another set of leftward-inclined teeth, both sets of teeth respectively formed on two helically slope-surfaces equally divided on a perimeter of said cylinder of said driving element, each set of teeth being operatively engaged with the lower tapered end of each said longitudinal key in said knob; a driving bellows having its upper end fixed in a disk portion formed on the bottom of said driving element and having its lower end fixed in a socket of a lower plate, said driving bellows being jacketed with a restoring spring therein; and a bottom plate having a bottom hole fluidically communicated with said driving bellows and with a tube which directs fluid from inside said driving bellows to a follower bellows of a spraying-angle adjuster, said bottom plate fixed on a toilet seat or a frame near the toilet and combined with said upper plate by several connecting means linked therebetween, said spraying-angle adjuster operatively adjusting the water spray angle of a rear-side nozzle or a front-side nozzle adapted for spraying either human anus or genitals portion, whereby upon the rotation of said rotating knob engagement of said longitudinal keys with said two sets of teeth will cause said driving element to descend and press said driving bellows to compress the fluid therein to expand the lower follower bellows for biasing either of said nozzles for selectively changing the desired optimum water-spray angle.

* * * * *